US009809923B2

(12) United States Patent
Lee et al.

(10) Patent No.: US 9,809,923 B2
(45) Date of Patent: Nov. 7, 2017

(54) LAUNDRY TREATMENT MACHINE AND METHOD OF OPERATING THE SAME

(71) Applicant: LG Electronics Inc., Seoul (KR)

(72) Inventors: Minkyeong Lee, Changwon-si (KR); Hoonbong Lee, Changwon-si (KR); Hamin Song, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 236 days.

(21) Appl. No.: 14/048,990

(22) Filed: Oct. 8, 2013

(65) Prior Publication Data

US 2014/0096327 A1 Apr. 10, 2014

(30) Foreign Application Priority Data

Oct. 9, 2012 (KR) ..... 10-2012-0111788

(51) Int. Cl.

| | |
|---|---|
| ***D06F 39/08*** | (2006.01) |
| ***D06F 33/02*** | (2006.01) |
| ***D06F 37/30*** | (2006.01) |
| ***D06F 39/00*** | (2006.01) |

(52) U.S. Cl.

CPC ..... *D06F 39/087* (2013.01); *D06F 33/02* (2013.01); *D06F 37/304* (2013.01); *D06F 39/003* (2013.01); *D06F 2202/085* (2013.01); *D06F 2202/10* (2013.01); *D06F 2204/065* (2013.01); *D06F 2204/086* (2013.01)

(58) Field of Classification Search

CPC ..... D06F 39/87; D06F 33/02; D06F 37/304; D06F 2202/85; D06F 2202/10; D06F 2204/065; D06F 2204/086

USPC ..... 8/158

See application file for complete search history.

(56) References Cited

U.S. PATENT DOCUMENTS

| | | | | |
|---|---|---|---|---|
| 4,916,768 | A * | 4/1990 | Broadbent | D06F 37/203 8/159 |
| 6,842,928 | B2 * | 1/2005 | Yang | D06F 37/304 68/12.04 |
| 2004/0163183 | A1 | 8/2004 | Kim | |
| 2005/0028299 | A1 * | 2/2005 | Jeon | D06F 39/003 8/159 |
| 2012/0060299 | A1 | 3/2012 | Kim et al. | |

FOREIGN PATENT DOCUMENTS

| | | | |
|---|---|---|---|
| CN | 1218121 | 6/1999 | |
| CN | 101177867 | 5/2008 | |
| EP | 0159202 A1 * | 10/1985 | D06F 39/003 |

(Continued)

*Primary Examiner* — Michael Barr
*Assistant Examiner* — Tinsae Ayalew
(74) *Attorney, Agent, or Firm* — Dentons US LLP

(57) ABSTRACT

Disclosed are a laundry treatment machine and a method of operating the same. The method of operating the laundry treatment machine includes performing a primary sensing of an amount of laundry within the tub, supplying water to a first water level within the tub, sensing the level of water within the tub, performing a secondary sensing of the amount of laundry within the tub, and judging whether the laundry includes dry laundry or wet laundry using the primarily sensed amount of laundry, the secondarily sensed amount of laundry, and the sensed water level value. This method ensures efficient implementation of sensing of amount of laundry.

11 Claims, 12 Drawing Sheets

(56) References Cited

FOREIGN PATENT DOCUMENTS

| | | | | | |
|---|---|---|---|---|---|
| EP | 0345120 | A1 * | 12/1989 | ..... | D06F 39/003 |
| EP | 0523864 | A1 * | 1/1993 | ..... | D06F 39/003 |
| KR | 10-1999-0055478 | | 7/1999 | | |
| KR | 10-1999-0055478 | A | 7/1999 | | |
| KR | 10-0789829 | | 1/2008 | | |
| KR | 10-2012-0004272 | | 1/2012 | | |
| KR | 10-2012-0028746 | | 3/2012 | | |
| WO | 2012/005511 | A2 | 1/2012 | | |
| WO | 2012-036422 | A2 | 3/2012 | | |

* cited by examiner

FIG. 12

1200

| SENSED VALUE | LEVEL |
|---|---|
| $Se_1$ | $L_1$ |
| $Se_2$ | $L_2$ |
| ⋮ | ⋮ |
| $Se_{10}$ | $L_{10}$ |

LAUNDRY TREATMENT MACHINE AND METHOD OF OPERATING THE SAME

CROSS-REFERENCE TO RELATED APPLICATION

This application claims the priority benefit of Korean Patent Application No. 10-2012-0111788 filed in Korea on Oct. 9, 2012, in the Korean Intellectual Property Office, the disclosure of which is incorporated herein by reference in its entirety.

BACKGROUND OF THE INVENTION

1. Field of the Invention

The present invention relates to a laundry treatment machine and a method of operating the same, and more particularly to a laundry treatment machine which may efficiently implement sensing of amount of laundry and a method of operating the laundry treatment machine.

2. Description of the Related Art

In general, a laundry treatment machine implements laundry washing using friction between laundry and a tub that is rotated upon receiving drive power of a motor in a state in which detergent, wash water and laundry are introduced into a drum. Such a laundry treatment machine may achieve laundry washing with less damage to laundry and without tangling of laundry.

A variety of methods of sensing amount of laundry have been discussed because laundry treatment machines implement laundry washing based on amount of laundry.

SUMMARY OF THE INVENTION

It is an object of the present invention to provide a laundry treatment machine which may efficiently implement sensing of amount of laundry and a method of operating the laundry treatment machine.

In accordance with one aspect of the present invention, the above and other objects can be accomplished by the provision of a method of operating a laundry treatment machine that processes laundry via rotation of a tub, the method including performing a primary sensing of an amount of laundry within the tub, supplying water to a first water level within the tub, sensing the level of water within the tub, performing a secondary sensing of the amount of laundry within the tub, and judging whether the laundry includes dry laundry or wet laundry using the primarily sensed amount of laundry, the secondarily sensed amount of laundry, and the sensed water level value.

In accordance with another aspect of the present invention, there is provided a laundry treatment machine including a tub, a motor to rotate the tub, and a controller to primarily sense an amount of laundry within the tub, to control a supply of water to a first water level within the tub, to sense the level of water within the tub, to secondarily sense the amount of the laundry within the tub, and to judge whether the laundry includes dry laundry or wet laundry using the primarily sensed amount of laundry, the secondarily sensed amount of laundry, and the sensed water level value.

BRIEF DESCRIPTION OF THE DRAWINGS

The above and other objects, features and other advantages of the present invention will be more clearly understood from the following detailed description taken in conjunction with the accompanying drawings, in which:

FIGS. 8 to 13 are reference views explaining the operating method of FIG. 7.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

With respect to constituent elements used in the following description, suffixes "module" and "unit" are given only in consideration of ease in the preparation of the specification, and do not have or serve as specially important meanings or roles. Thus, the "module" and "unit" may be mingled with each other.

Figure 1:
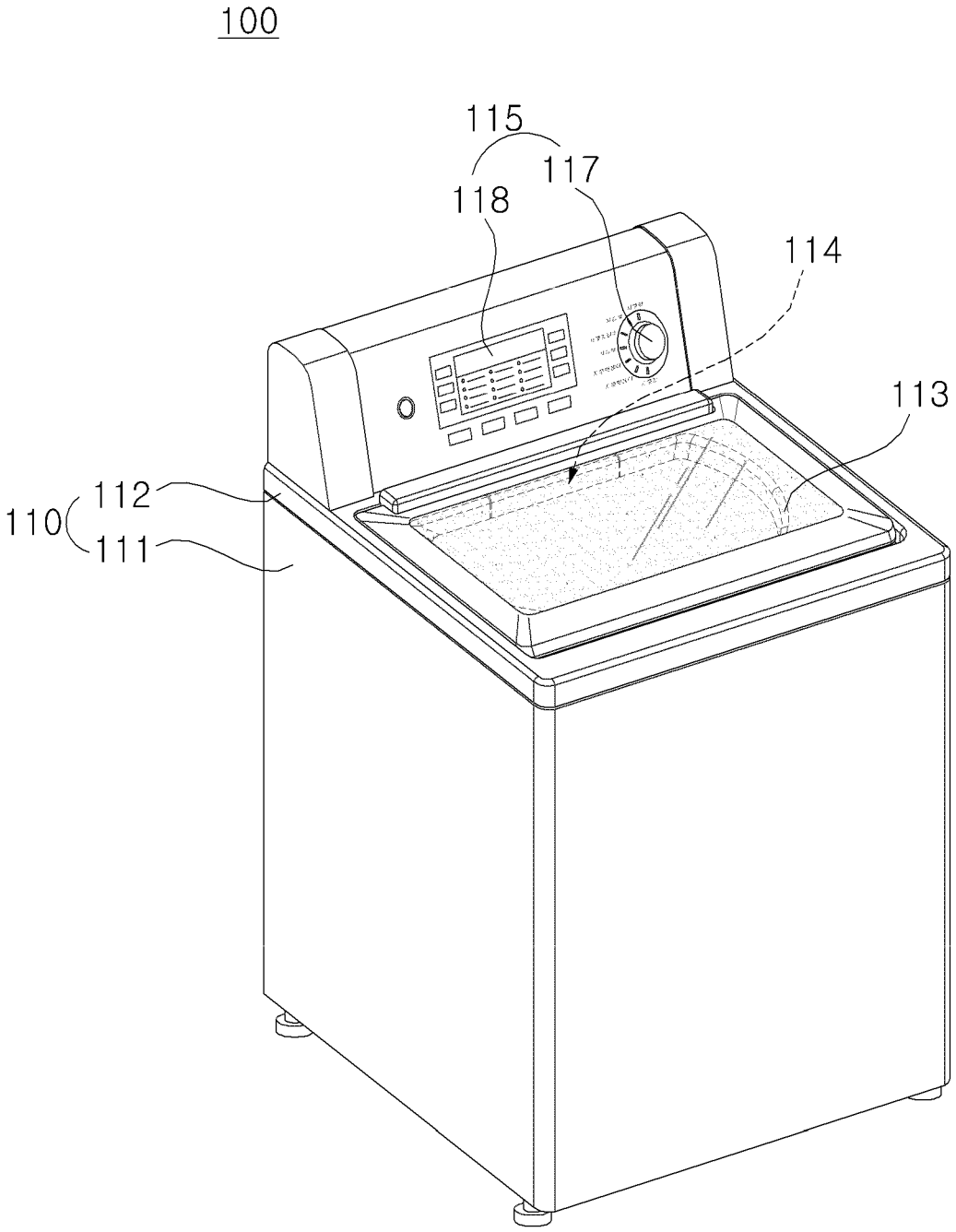
FIG. 1 is a perspective view showing a laundry treatment machine according to an embodiment of the present invention.
Figure 2:
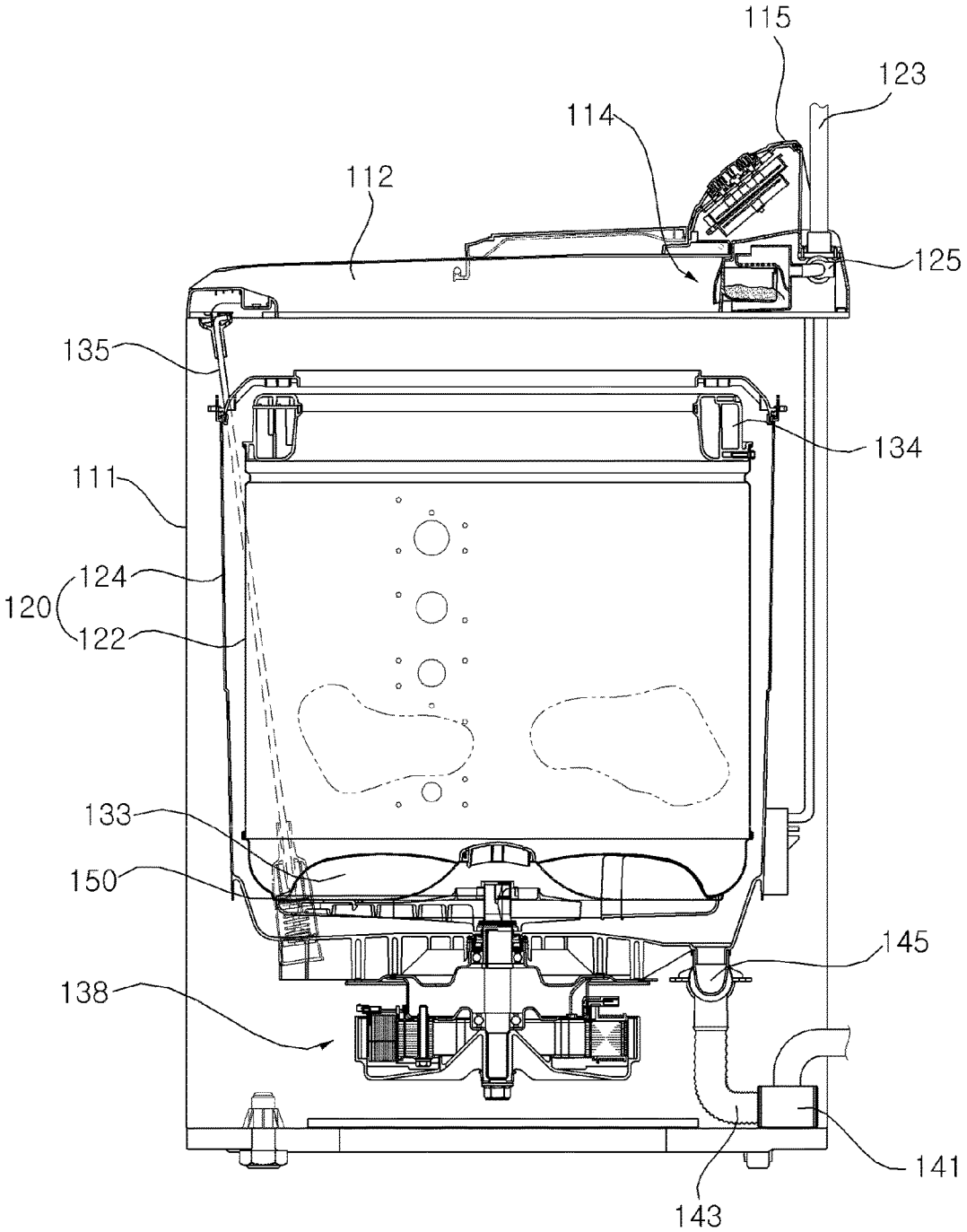
FIG. 2 is a side sectional view of the laundry treatment machine shown in FIG. 1.

FIG. 1 is a perspective view showing a laundry treatment machine according to an embodiment of the present invention, and FIG. 2 is a side sectional view of the laundry treatment machine shown in FIG. 1.

Referring to FIGS. 1 and 2, the laundry treatment machine 100 according to an embodiment of the present invention includes a washing machine that implements, e.g., washing, rinsing, and dehydration of laundry introduced thereinto, or a drying machine that implements drying of wet laundry introduced thereinto. The following description will focus on a washing machine.

The washing machine 100 includes a casing 110 defining the external appearance of the washing machine 100, a control panel 115 that includes manipulation keys to receive a variety of control commands from a user, a display unit to display information regarding an operational state of the washing machine 100, and the like, thus providing a user interface, and a door 113 rotatably coupled to the casing 110 to open or close an opening for introduction and removal of laundry.

The casing 110 may include a main body 111 defining a space in which a variety of components of the washing machine 100 may be accommodated, and a top cover 112 provided at the top of the main body 111, the top cover 112 having a fabric introduction/removal opening to allow laundry to be introduced into an inner tub 122.

The casing 110 is described as including the main body 111 and the top cover 112, but is not limited thereto, and any other casing configuration defining the external appearance of the washing machine 100 may be considered.

Meanwhile, a support rod 135 will be described as being coupled to the top cover 112 that constitutes the casing 110, but is not limited thereto, and it is noted that the support rod 135 may be coupled to any fixed portion of the casing 110.

The control panel 115 includes manipulation keys 117 to set an operational state of the washing machine 100 and a display unit 118 located at one side of the manipulation keys 117 to display an operational state of the laundry treatment machine 100.

The door 113 is used to open or close a fabric introduction/removal opening (not designated) formed in the top cover 112. The door 113 may include a transparent member, such as tempered glass or the like, to allow the user to view the interior of the main body 111.

The washing machine 100 may include a tub 120. The tub 120 may consist of an outer tub 124 in which wash water is accommodated, and an inner tub 122 in which laundry is accommodated, the inner tub 122 being rotatably placed within the outer tub 124. A balancer 134 may be provided in an upper region of the tub 120 to compensate for eccentricity generated during rotation of the tub 120.

In addition, the washing machine 100 may include a pulsator 133 rotatably mounted at a bottom surface of the tub 120.

A drive device 138 serves to supply drive power required to rotate the inner tub 122 and/or the pulsator 133. A clutch (not shown) may be provided to selectively transmit drive power of the drive device 138 such that only the inner tub 122 is rotated, only the pulsator 133 is rotated, or both the inner tub 122 and the pulsator 133 are concurrently rotated.

Figure 3:
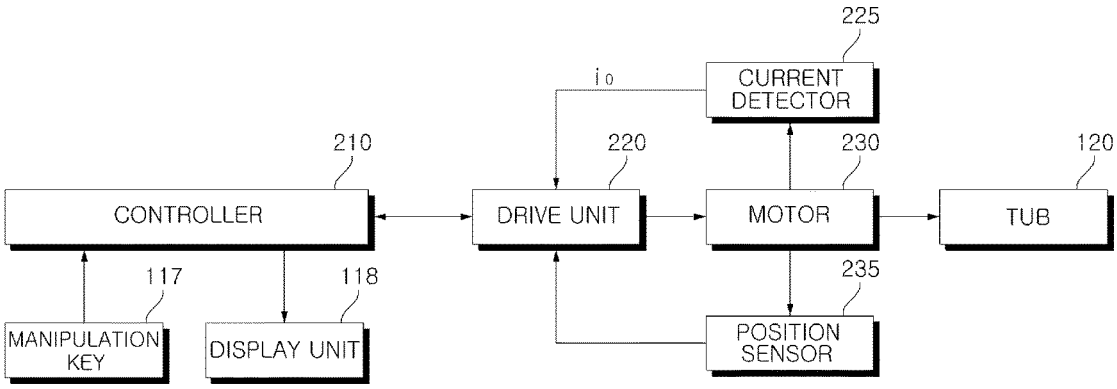
FIG. 3 is a block diagram of inner components of the laundry treatment machine shown in FIG. 1.

The drive device 138 is actuated by a drive unit 220 of FIG. 3, i.e. a drive circuit. This will hereinafter be described with reference to FIG. 3 and the following drawings.

In addition, a detergent box 114, in which a variety of additives, such as detergent for washing, fabric conditioner, and/or bleach, are accommodated, is installed to the top cover 112 so as to be pulled or pushed from or to the top cover 112. Wash water supplied through a water supply passageway 123 is supplied into the inner tub 122 by way of the detergent box 114.

The inner tub 122 has a plurality of holes (not shown) such that wash water supplied into the inner tub 122 flows to the outer tub 124 through the plurality of holes. A water supply valve 125 may be provided to control the flow of wash water through the water supply passageway 123.

Wash water in the outer tub 124 is discharged through a water discharge passageway 143. A water discharge valve 145 to control the flow of wash water through the water discharge passageway 143 and a water discharge pump 141 to pump wash water may be provided.

The support rod 135 serves to suspend the outer tub 124 to the casing 110. One end of the support rod 135 is connected to the casing 110, and the other end of the support rod 135 is connected to the outer tub 124 via a suspension 150.

The suspension 150 serves to attenuate vibration of the outer tub 124 during operation of the washing machine 100. For example, the outer tub 124 may vibrate as the inner tub 122 is rotated. During rotation of the inner tub 122, the suspension 150 may attenuate vibration caused by various factors, such as eccentricity of laundry accommodated in the inner tub 122, the rate of rotation or resonance of the inner tub 122, and the like.

FIG. 3 is a block diagram of inner components of the laundry treatment machine shown in FIG. 1.

Referring to FIG. 3, in the laundry treatment machine 100, a drive unit 220 is controlled to drive a motor 230 under control of a controller 210, and in turn the tub 120 is rotated by the motor 230.

The controller 210 is operated upon receiving an operating signal input by the manipulation keys 1017. Thereby, washing, rinsing and dehydration processes may be implemented.

In addition, the controller 210 may control the display unit 118 to thereby control display of washing courses, washing time, dehydration time, rinsing time, current operational state, and the like.

In addition, the controller 210 may control the drive unit 220 to operate the motor 230. For example, the controller 210 may control the drive unit 220 to rotate the motor 230 based on signals from a current detector 225 that detects output current flowing through the motor 230 and a position sensor 235 that senses a position of the motor 230. The drawing illustrates detected current and sensed position signal input to the drive unit 220, but the disclosure is not limited thereto, and the same may be input to the controller 210 or may be input to both the controller 210 and the drive unit 220.

The drive unit 220, which serves to drive the motor 230, may include an inverter (not shown) and an inverter controller (not shown). In addition, the drive unit 220 may further include a converter to supply Direct Current (DC) input to the inverter (not shown), for example.

For example, if the inverter controller (not shown) outputs a Pulse Width Modulation (PWM) type switching control signal (Sic of FIG. 4) to the inverter (not shown), the inverter (not shown) may supply a predetermined frequency of Alternating Current (AC) power to the motor 230 via implementation of fast switching.

The drive unit 220 will be described hereinafter in greater detail with reference to FIG. 4.

In addition, the controller 210 may function to detect amount of laundry based on current $i_o$ detected by the current detector 225 or a position signal H sensed by the position sensor 235. For example, the controller 210 may detect amount of laundry based on a current value $i_o$ of the motor 230 during rotation of the tub 120.

The controller 210 may also function to detect eccentricity of the tub 120, i.e. unbalance (UB) of the tub 120. Detection of eccentricity may be implemented based on variation in the rate of rotation of the tub 120 or a ripple component of current $i_o$ detected by the current detector 220.

Figure 4:
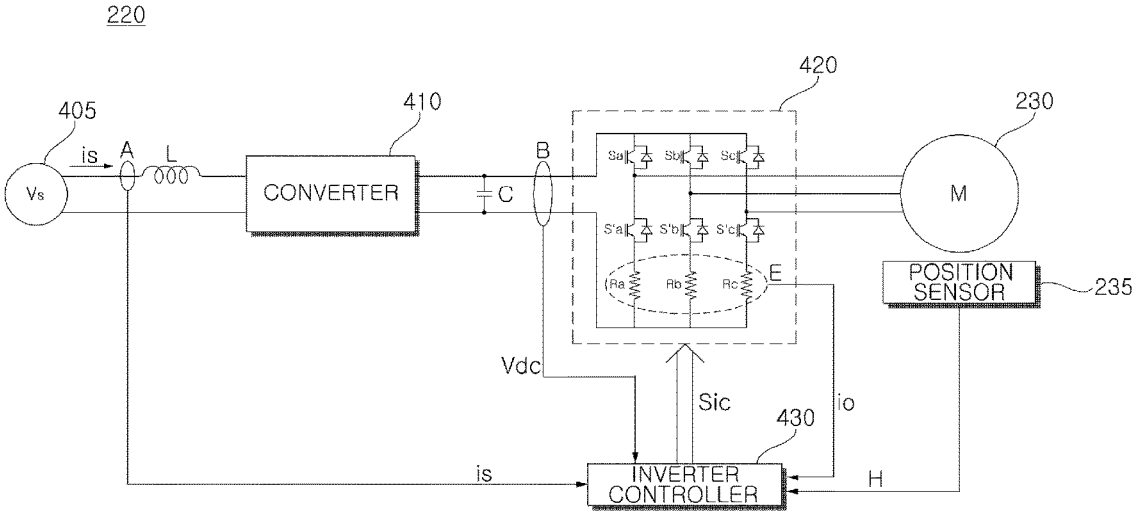
FIG. 4 is a circuit diagram of a drive unit shown in FIG. 3.

FIG. 4 is a circuit diagram of the drive unit shown in FIG. 3.

Referring to FIG. 4, the drive unit 220 according to an embodiment of the present invention may include a converter 410, an inverter 420, an inverter controller 430, a DC terminal voltage detector B, a smoothing capacitor C, and an output current detector E. In addition, the drive unit 220 may further include an input current detector A and a reactor L, for example.

The reactor L is located between a commercial AC power source (405, $v_s$) and the converter 410 and implements power factor correction or boosting. In addition, the reactor L may function to restrict harmonic current due to fast switching.

The input current detector A may detect input current $i_s$ input from the commercial AC power source 405. To this end, a current transformer (CT), shunt resistor or the like may be used as the input current detector A. The detected input current $i_s$ may be a discrete pulse signal and be input to the controller 430.

The converter 410 converts and outputs AC power, received from the commercial AC power source 405 and passed through the reactor L, into DC power. FIG. 4 illustrates the commercial AC power source 405 as a single phase AC power source, but the commercial AC power source 405 may be a three-phase AC power source. Depending on the kind of the commercial AC power source 405, the internal configuration of the converter 410 varies.

The converter 410 may be constituted of diodes, and the like without a switching element, and implement rectification without switching.

For example, the converter 410 may include four diodes in the form of a bridge assuming a single phase AC power source, or may include six diodes in the form of a bridge assuming three-phase AC power source.

Alternatively, the converter 410 may be a half bridge type converter in which two switching elements and four diodes are interconnected. Under assumption of a three phase AC power source, the converter 410 may include six switching elements and six diodes.

If the converter 410 includes a switching element, the converter 410 may implement boosting, power factor correction, and DC power conversion via switching by the switching element.

The smoothing capacitor C implements smoothing of input power and stores the same. FIG. 4 illustrates a single smoothing capacitor C, but a plurality of smoothing capacitors may be provided to achieve stability.

FIG. 4 illustrates that the smoothing capacitor C is connected to an output terminal of the converter 410, but the disclosure is not limited thereto, and DC power may be directly input to the smoothing capacitor C. For example, DC power from a solar battery may be directly input to the smoothing capacitor C, or may be DC/DC converted and them input to the smoothing capacitor C. The following description will focus on illustration of the drawing.

Both terminals of the smoothing capacitor C store DC power, and thus may be referred to as a DC terminal or a DC link terminal.

The dc terminal voltage detector B may detect voltage Vdc at either dc terminal of the smoothing capacitor C. To this end, the dc terminal voltage detector B may include a resistor, an amplifier and the like. The detected dc terminal voltage Vdc may be a discrete pulse signal and be input to the inverter controller 430.

The inverter 420 may include a plurality of inverter switching elements, and convert smoothed DC power Vdc into a predetermined frequency of three-phase AC power va, vb, vc via On/off switching by the switching elements to thereby output the same to the three-phase synchronous motor 230.

The inverter 420 includes a pair of upper arm switching elements Sa, Sb, Sc and lower arm switching elements S'a, S'b, S'c which are connected in series, and a total of three pairs of upper and lower arm switching elements Sa & S'a, Sb & S'b, Sc & S'c are connected in parallel. Diodes are connected in anti-parallel to the respective switching elements Sa, S'a, Sb, S'b, Sc, S'c.

The switching elements included in the inverter 420 are respectively turned on or off based on an inverter switching control signal Sic from the inverter controller 430. Thereby, three-phase AC power having a predetermined frequency is output to the three-phase synchronous motor 230.

The inverter controller 430 may control switching in the inverter 420. To this end, the inverter controller 430 may receive output current $i_o$ detected by the output current detector E.

To control switching in the inverter 420, the inverter controller 430 outputs an inverter switching control signal Sic to the inverter 420. The inverter switching control signal Sic is a PWM switching control signal, and is generated and output based on an output current value $i_o$ detected by the output current detector E. A detailed description related to output of the inverter switching control signal Sic in the inverter controller 430 will follow with reference to FIG. 5.

The output current detector E detects output current $i_o$ flowing between the inverter 420 and the three-phase synchronous motor 230. That is, the output current detector E detects current flowing through the motor 230. The output current detector E may detect each phase output current ia, ib, ic, or may detect two-phase output current using three-phase balance.

The output current detector E may be located between the inverter 420 and the motor 230. To detect current, a current transformer (CT), shunt resistor, or the like may be used as the output current detector E.

Assuming use of a shunt resistor, three shunt resistors may be located between the inverter 420 and the synchronous motor 230, or may be respectively connected at one end thereof to the three lower arm switching elements S'a, S'b, S'c. Alternatively, two shunt resistors may be used based on three-phase balance. Yet alternatively, assuming use of a single shunt resistor, the shunt resistor may be located between the above-described capacitor C and the inverter 420.

The detected output current $i_o$ may be a discrete pulse signal, and be applied to the inverter controller 430. Thus, the inverter switching control signal Sic is generated based on the detected output current $i_o$. The following description will explain that the detected output current $i_o$ is three-phase output current ia, ib, ic.

The three-phase synchronous motor 230 includes a stator and a rotor. The rotor is rotated as a predetermined frequency of each phase AC power is applied to a coil of the stator having each phase a, b, c.

The motor 230, for example, may include a Surface Mounted Permanent Magnet Synchronous Motor (SMPMSM), Interior Permanent Magnet Synchronous Magnet Synchronous Motor (IPMSM), or Synchronous Reluctance Motor (SynRM). Among these motors, the SMPMSM and the IPMSM are Permanent Magnet Synchronous Motors (PMSMs), and the SynRM contains no permanent magnet.

Assuming that the converter 410 includes a switching element, the inverter controller 430 may control switching by the switching element included in the converter 410. To this end, the inverter controller 430 may receive input current $i_s$ detected by the input current detector A. In addition, to control switching in the converter 410, the inverter controller 430 may output a converter switching control signal Scc to the converter 410. The converter switching control signal Scc may be a PWM switching control signal and may be generated and output based on input current $i_s$ detected by the input current detector A.

The position sensor 235 may sense a position of the rotor of the motor 230. To this end, the position sensor 235 may include a hall sensor. The sensed position of the rotor H is input to the inverter controller 430 and used for velocity calculation.

Figure 5:
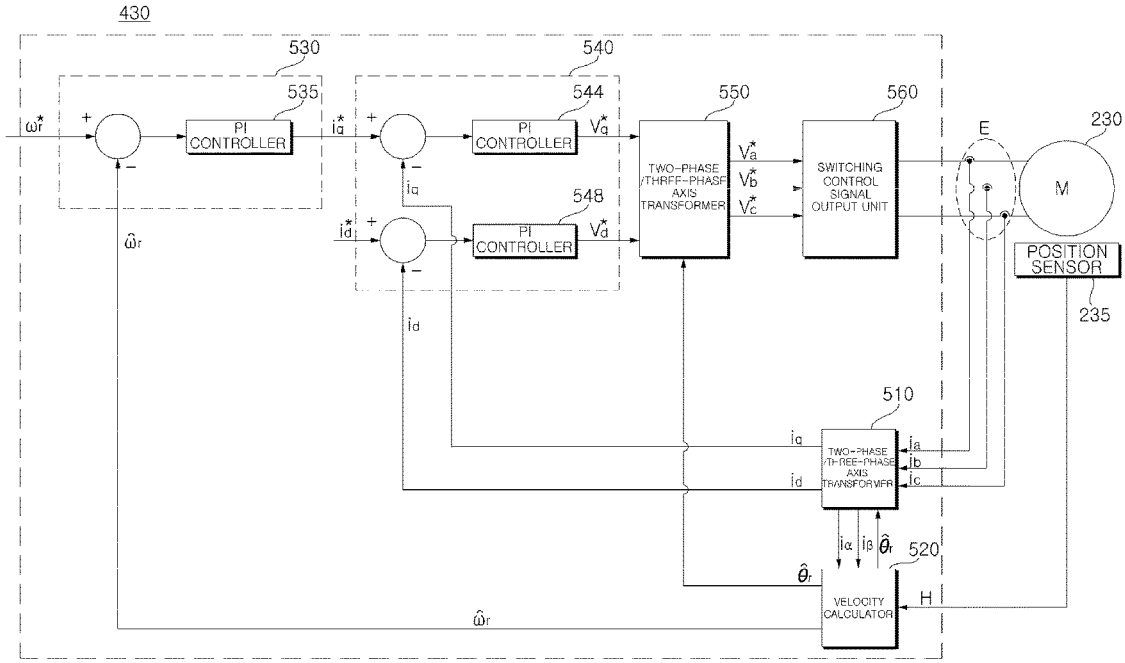
FIG. 5 is a block diagram of an inverter controller shown in FIG. 4.

FIG. 5 is a block diagram of the inverter controller shown in FIG. 4.

Referring to FIG. 5, the inverter controller 430 may include an axis transformer 510, a velocity calculator 520, a current command generator 530, a voltage command generator 540, an axis transformer 550, and a switching control signal output unit 560.

The axis transformer 510 receives three-phase output current ia, ib, is detected by the output current detector E, and converts the same into two-phase current iα, iβ of an absolute coordinate system.

The axis transformer 510 may transform the two-phase current iα, iβ of an absolute coordinate system into two-phase current id, iq of a polar coordinate system.

The velocity calculator 520 may calculate velocity $\hat{\omega}_r$ based on the rotor position signal H input from the position sensor 235. That is, based on the position signal, the velocity may be calculated via division with respect to time.

The velocity calculator 520 may output the calculated position $\hat{\theta}_r$ and the calculated velocity $\hat{\omega}_r$ based on the input rotor position signal H.

The current command generator 530 generates a current command value $i^*_q$ based on the calculated velocity $\hat{\omega}_r$ and a velocity command value $\omega^*_r$. For example, the current command generator 530 may generate the current command value $i^*_q$ based on a difference between the calculated velocity $\omega_r$ and the velocity command value $\omega^*_r$ while a PI controller 535 implements PI control. Although the drawing illustrates the q-axis current command value $i^*_q$, alternatively, a d-axis current command value $i^*_d$ may be further generated. The d-axis current command value $i^*_d$ may be set to zero.

The current command generator 530 may include a limiter (not shown) that limits the level of the current command value $i^*_q$ to prevent the current command value $i^*_q$ from exceeding an allowable range.

Next, the voltage command generator 540 generates d-axis and q-axis voltage command values $v^*_d$, $v^*_q$ based on d-axis and q-axis current $i_d$, $i_q$, which have been axis-transformed into a two-phase polar coordinate system by the axis transformer, and the current command values $i^*_d$, $i^*_q$ from the current command generator 530. For example, the voltage command generator 540 may generate the q-axis voltage command value $v^*_q$ based on a difference between the q-axis current $i_q$ and the q-axis current command value $i^*_q$ while a PI controller 544 implements PI control. In addition, the voltage command generator 540 may generate the d-axis voltage command value $v^*_d$ based on a difference between the d-axis current $i_d$ and the d-axis current command value $i^*_d$ while a PI controller 548 implements PI control. The d-axis voltage command value $v^*_d$ may be set to zero to correspond to the d-axis current command value $i^*_d$ that is set to zero.

The voltage command generator 540 may include a limiter (not shown) that limits the level of the d-axis and q-axis voltage command values $v^*_d$, $v^*_q$ to prevent these voltage command values $v^*_d$, $v^*_q$ from exceeding an allowable range.

The generated d-axis and q-axis voltage command values $v^*_d$, $v^*_q$ are input to the axis transformer 550.

The axis transformer 550 receives the calculated position $\hat{\theta}_r$ from the velocity calculator 520 and the d-axis and q-axis voltage command values $v^*_d$, $v^*_q$ to implement axis transformation of the same.

First, the axis transformer 550 implements transformation from a two-phase polar coordinate system into a two-phase absolute coordinate system. In this case, the calculated position $\hat{\theta}_r$ from the velocity calculator 520 may be used.

The axis transformer 550 implements transformation from the two-phase absolute coordinate system into a three-phase absolute coordinate system. Through this transformation, the axis transformer 550 outputs three-phase output voltage command values v*a, v*b, v*c.

The switching control signal output unit 560 generates and outputs a PWM inverter switching control signal Sic based on the three-phase output voltage command values v*a, v*b, v*c.

The output inverter switching control signal Sic may be converted into a gate drive signal by a gate drive unit (not shown), and may then be input to a gate of each switching element included in the inverter 420. Thereby, the respective switching elements Sa, S'a, Sb, S'b, Sc, S'c included in the inverter 420 implement switching.

In the embodiment of the present invention, the switching control signal output unit 560 may generate and output an inverter switching control signal Sic as a mixture of two-phase PWM and three-phase PWM inverter switching control signals.

For example, the switching control signal output unit 560 may generate and output a three-phase PWM inverter switching control signal Sic in an accelerated rotating section that will be described hereinafter, and generate and output a two-phase PWM inverter switching control signal Sic in a constant velocity rotating section.

Figure 6:
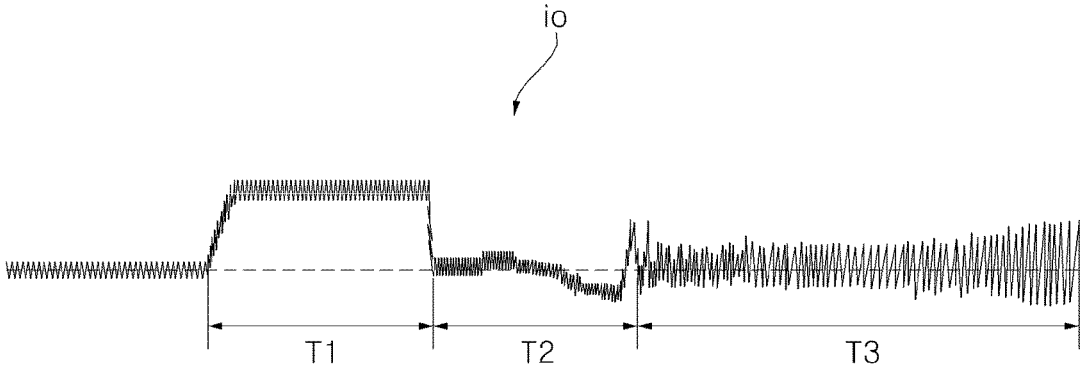
FIG. 6 is a view showing one example of alternating current supplied to a motor of FIG. 4.

FIG. 6 is a view showing one example of alternating current supplied to the motor of FIG. 4.

Referring to FIG. 6, current flowing through the motor 230 depending on switching in the inverter 420 is illustrated.

More specifically, an operation section of the motor 230 may be divided into a start-up operation section T1 as an initial operation section and a normal operation section T3 after initial start-up operation.

The start-up operation section T1 may be referred to as a motor alignment section during which constant current is applied to the motor 230. That is, to align the rotor of the motor 230 that remains stationary at a given position, any one switching element among the three upper arm switching elements of the inverter 420 is turned on, and the other two lower arm switching elements, which are not paired with the turned-on upper arm switching element, are turned on.

The magnitude of constant current may be several A. To supply the constant current to the motor 230, the inverter controller 430 may apply a start-up switching control signal Sic to the inverter 420.

In the embodiment of the present invention, the start-up operation section T1 may be subdivided into a section during which first current is applied and a section during which second current is applied. This serves to acquire an equivalent resistance value of the motor 230, for example. This will be described hereinafter with reference to FIG. 7 and the following drawings.

A forced acceleration section T2 during which the velocity of the motor 230 is forcibly increased may further be provided between the initial start-up section T1 and the normal operation section T3. In this section T2, the velocity of the motor 230 is increased in response to a velocity command without feedback of current $i_o$ flowing through the motor 230. The inverter controller 430 may output a corresponding switching control signal Sic. In the forced acceleration section T2, feedback control as described above with respect to FIG. 5, i.e. vector control is not implemented.

In the normal operation section T3, as feedback control based on the detected output current $i_o$ as described above with reference to FIG. 5 may be implemented in the inverter controller 430, a predetermined frequency of AC power may be applied to the motor 230. This feedback control may be referred to as vector control.

According to the embodiment of the present invention, the normal operation section T3 may include an accelerated rotating section and a constant velocity rotating section.

More specifically, as described above with reference to FIG. 5, a velocity command value is set to constantly increase in the accelerated rotating section and is set to be constant in the constant velocity rotating section. In addition, in both the accelerated rotating section and the constant velocity rotating section, the detected output current $i_o$ may be fed back, and sensing of amount of laundry may be accomplished using a current command value difference based on the output current $i_o$. This may ensure efficient sensing of amount of laundry.

Alternatively, differently from the above description, the accelerated rotating section may be included in the forced acceleration section T2, and the constant velocity rotating section may be included in the normal operation section T3.

In this case, a current command value during the accelerated rotating section is not based on the detected output current $i_o$. Thus, sensing of amount of laundry may be implemented using a current command value during the accelerated rotating section and a current command value during the constant velocity rotating section.

Figure 7:
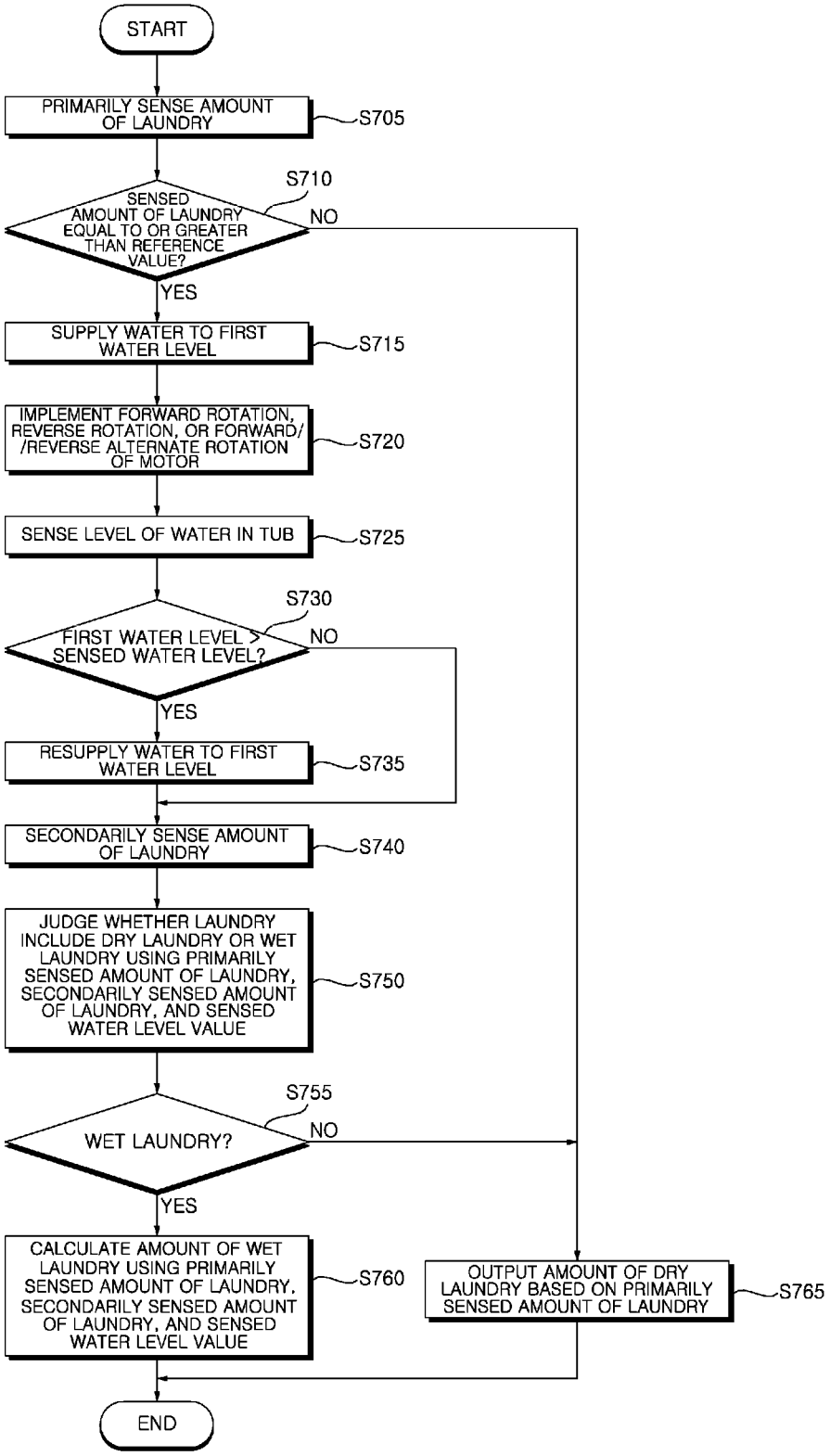
FIG. 7 is a flowchart showing a method of operating a laundry treatment machine according to an embodiment of the present invention.

FIG. 7 is a flowchart showing a method of operating a laundry treatment machine according to one embodiment of the present invention, and FIGS. 8 to 13 are reference views explaining the operating method of FIG. 7.

Referring to FIG. 7, the controller 210 of the laundry treatment machine primarily senses the amount of laundry in the tub (S705).

Sensing of amount of laundry may be accomplished in various ways.

In one example, a method of sensing amount of laundry according to an embodiment of the present invention may include sensing amount of laundry in a tub based on a current command value to drive a motor during an acceleration section and a current command value to drive the motor during a constant velocity section. In addition, as back electromotive force generated in the motor during the constant velocity section is calculated and in turn the calculated back electromotive force is utilized upon sensing of amount of laundry, the amount of laundry may be sensed with enhanced accuracy. This method of sensing amount of laundry In another example of the method of sensing amount of laundry may include accelerating a rotation velocity of a tub, and sensing amount of laundry in the tub based on a current command value to drive a motor that is used to rotate the tub during an acceleration section or output current flowing through the motor.

Figure 13:
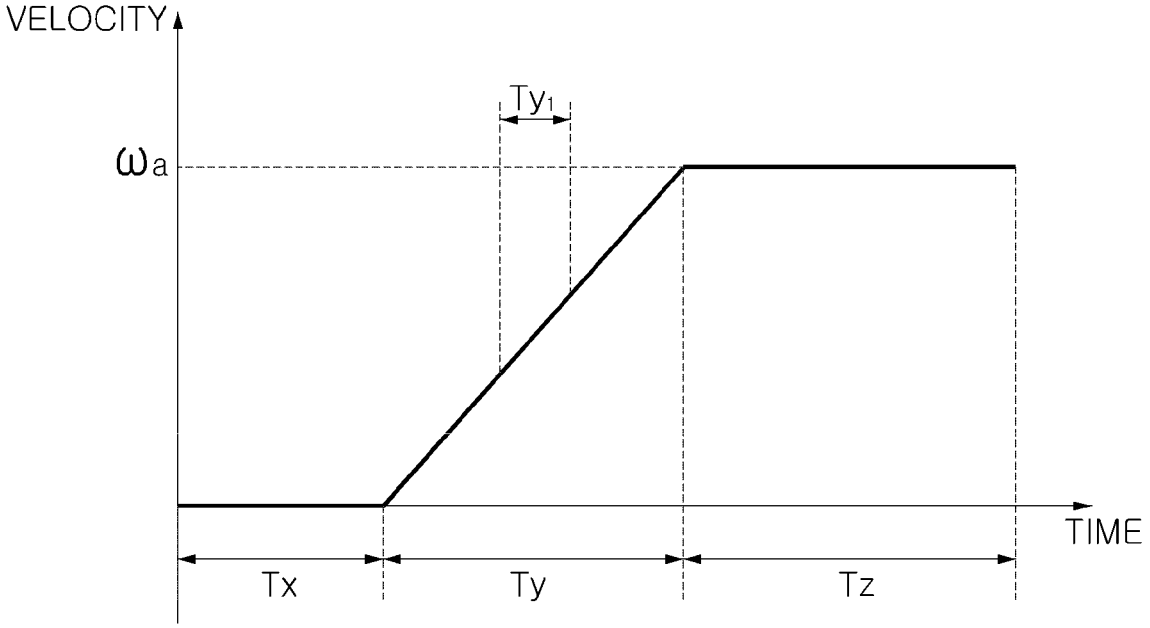

FIG. 13 illustrates implementation of sensing of amount of laundry during an acceleration section.

Referring to FIG. 13, a Tx section is a motor alignment section, a Ty section is a motor accelerated rotating section, and a Tz section is a motor constant velocity rotating section.

In the method of sensing amount of laundry, the amount of laundry may be sensed based on a current command value for a partial section $Ty_1$ among the motor accelerated rotating section.

It is noted that the aforementioned methods of sensing amount of laundry may be equally applied to operation S705 as well as secondary sensing of amount of laundry S740 that will be described hereinafter.

Next, the controller 210 judges whether or not the sensed amount of laundry is equal to or greater than a reference value (S710). If the sensed amount of laundry is less than the reference value, the controller 210 directly judges dry laundry, and implements operation S765. If the sensed amount of laundry is equal to or greater than the reference value, the controller 210 implements operation S715 and following operations.

That is, the controller 210 judges dry laundry if the sensed amount of laundry is less than the reference value, but implements operation S715 and following operations assuming the potential of wet laundry if the sensed amount of laundry is equal to or greater than the reference value.

Next, the controller 210 controls supply of wash water to a first water level in the tub (S715). Then, the controller 210 controls a motor that is used to rotate the tub such that the motor performs forward/reverse alternate rotation (S720). Then, the controller 210 senses the level of wash water in the tub (S725).

Figure 11A:
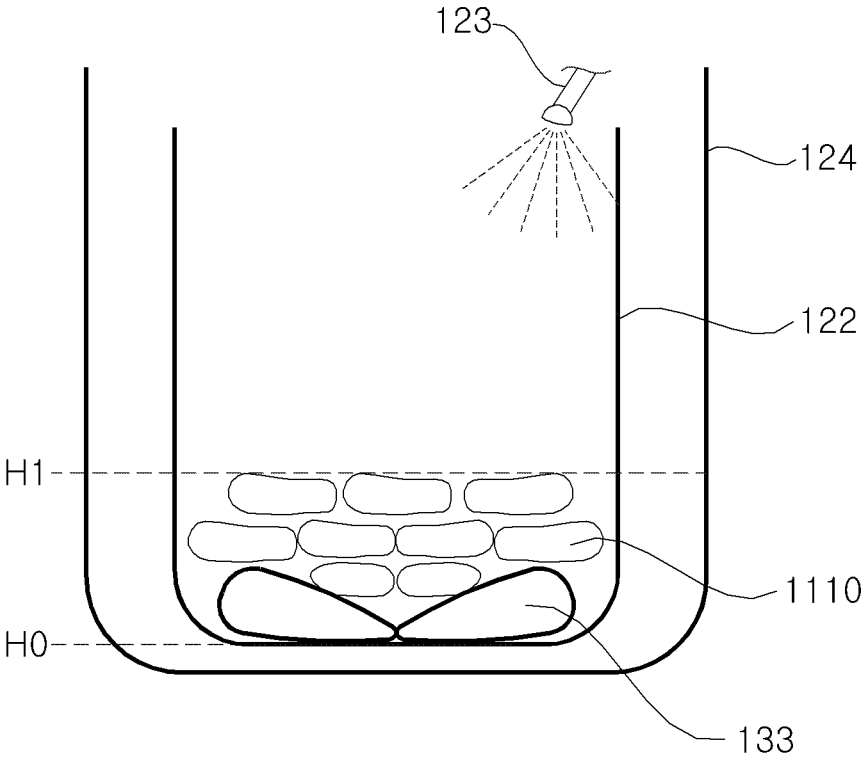

FIG. 11A illustrates supply of wash water to a first water level in the tub, more particularly, the outer tub 124. To this end, the controller 210 may control the water supply valve 125 that controls the flow of wash water through the water supply passageway 123. That is, the controller 210 may control the water supply valve 125 such that wash water is supplied to the first water level.

Figure 11B:
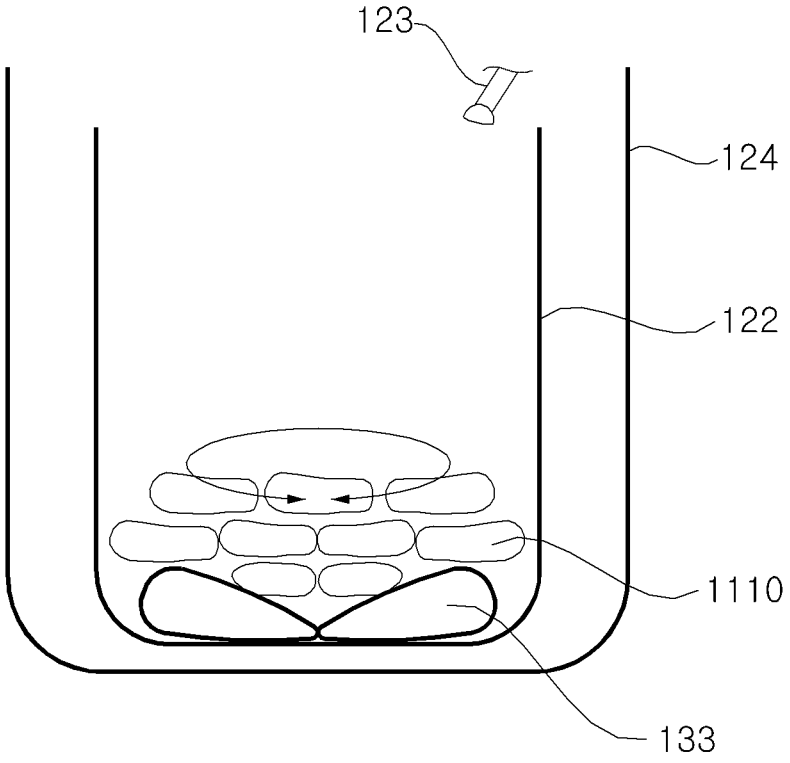

Next, FIG. 11B illustrates forward/reverse alternate rotation of the motor that is used to rotate the tub. This rotation serves to allow laundry (laundry) in the tub to be completely wetted. The motor may be rotated forward or in reverse for a given time.

Figure 11C:
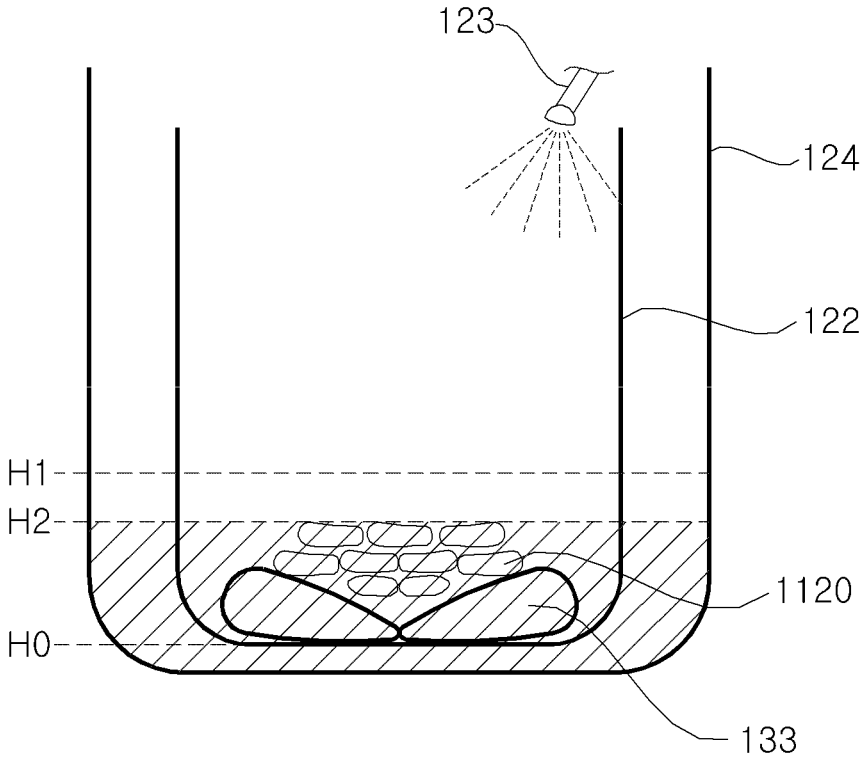

FIG. 11C illustrates that laundry absorbs the supplied water based on forward/reverse alternate rotation of the motor of FIG. 11B, and thus the water level is lowered.

Measurement of the water level may be implemented via a water level sensor. For example, a water level frequency corresponding to a zero water level H0 may be 28 KHz, a water level frequency corresponding to a water level H1 may be 25.9 KHz, and a water level frequency corresponding to a water level H2 may be approximately 26.5 KHz. The water level frequency, i.e. the water level value may be inversely proportional to the level of water in the tub.

In an embodiment of the present invention, through use of the water level frequency, judgment of dry laundry/wet laundry may be implemented, and moreover calculation of the amount of wet laundry may be implemented. This will be understood with reference to operation S760.

Next, the controller 210 judges whether or not the first water level is higher than the sensed water level (S730). If the first water level is higher than the sensed water level, the controller 210 controls resupply of wash water to the first water level (S735).

To this end, the controller 210 may control the water supply valve 125 to control the water supply passageway 123. That is, the controller 210 may control the water supply valve 125 to resupply water to the first water level.

Next, the controller 210 secondarily senses amount of the laundry in the tub (S740). Then, the controller 210 judges whether the laundry includes dry laundry or wet laundry using the primarily sensed amount of laundry, the secondarily sensed amount of laundry, and the sensed water level (S750).

The secondary sensing of amount of laundry may be implemented in various ways as described above with reference to operation S705.

The controller 210 judges wet laundry if the primarily sensed amount of laundry is greater or the sensed water level value is lower.

That is, the controller 210 judges dry laundry if the primarily sensed amount of laundry is smaller or the sensed water level value is higher.

Alternatively, the controller 210 judges dry laundry if a difference between the sensed water level value and the first water level value is greater.

Operation S760 is implemented under judgment of wet laundry, whereas operation S765 is implemented under judgment of dry laundry.

More specifically, in the case of wet laundry, the controller 210 calculates the amount of wet laundry based on the primarily sensed amount of laundry, the secondarily sensed amount of laundry, and the sensed water level (S760). Here, the amount of wet laundry means an inherent amount of laundry assuming that the laundry does not absorb water.

Calculation of the amount of wet laundry may be implemented by subtracting the amount of water from the amount of water and laundry. That is, this may mean calculation of the inherent amount of laundry.

Here, the greater the difference between the secondarily sensed amount of laundry and the primarily sensed amount of laundry, this means wet laundry that contain a smaller amount of water. The smaller the difference between the secondarily sensed amount of laundry and the primarily sensed amount of laundry, this means wet laundry that contain a greater amount of water.

Alternatively, the greater the water level frequency corresponding to the sensed water level, this means wet laundry that contain a greater amount of water. The smaller the water level frequency corresponding to the sensed water level, this means wet laundry that contain a smaller amount of water.

In this way, the amount of wet laundry may be greater as the difference between the secondarily sensed amount of laundry and the primarily sensed amount of laundry is greater or the water level frequency corresponding to the sensed water level is smaller. Alternatively, the amount of wet laundry may be greater as the difference between the sensed water level value and the first water level value is smaller.

In other words, the amount of wet laundry may be smaller as the difference between the secondarily sensed amount of laundry and the primarily sensed amount of laundry is smaller or the water level frequency corresponding to the sensed water level is greater. Alternatively, the amount of wet laundry may be smaller as the difference between the sensed water level value and the first water level value is greater.

As described above, according to the embodiment of the present invention, laundry treatment depending on an inherent fabric weight is possible as a result of sensing the inherent amount of laundry assuming that the laundry does not absorb water, which may cause reduced washing time and reduced water consumption. In conclusion, energy consumption by the laundry treatment machine may be reduced.

On the other hand, in the case of dry laundry, the controller 210 calculates the amount of dry laundry based on the primarily sensed amount of laundry (S765).

The controller 210 may judge that the amount of dry laundry is greater as the primarily sensed amount of laundry increases.

The amount of dry laundry may be output via table 1200 of FIG. 12. The amount of dry laundry may be output based on each current command value assuming that current command values between an acceleration section and a constant velocity section are sorted into a plurality of sections Se1, . . . , Se10. That is, any one value of $L_1$ to $L_{10}$ may be output as the amount of dry laundry.

Figure 8:
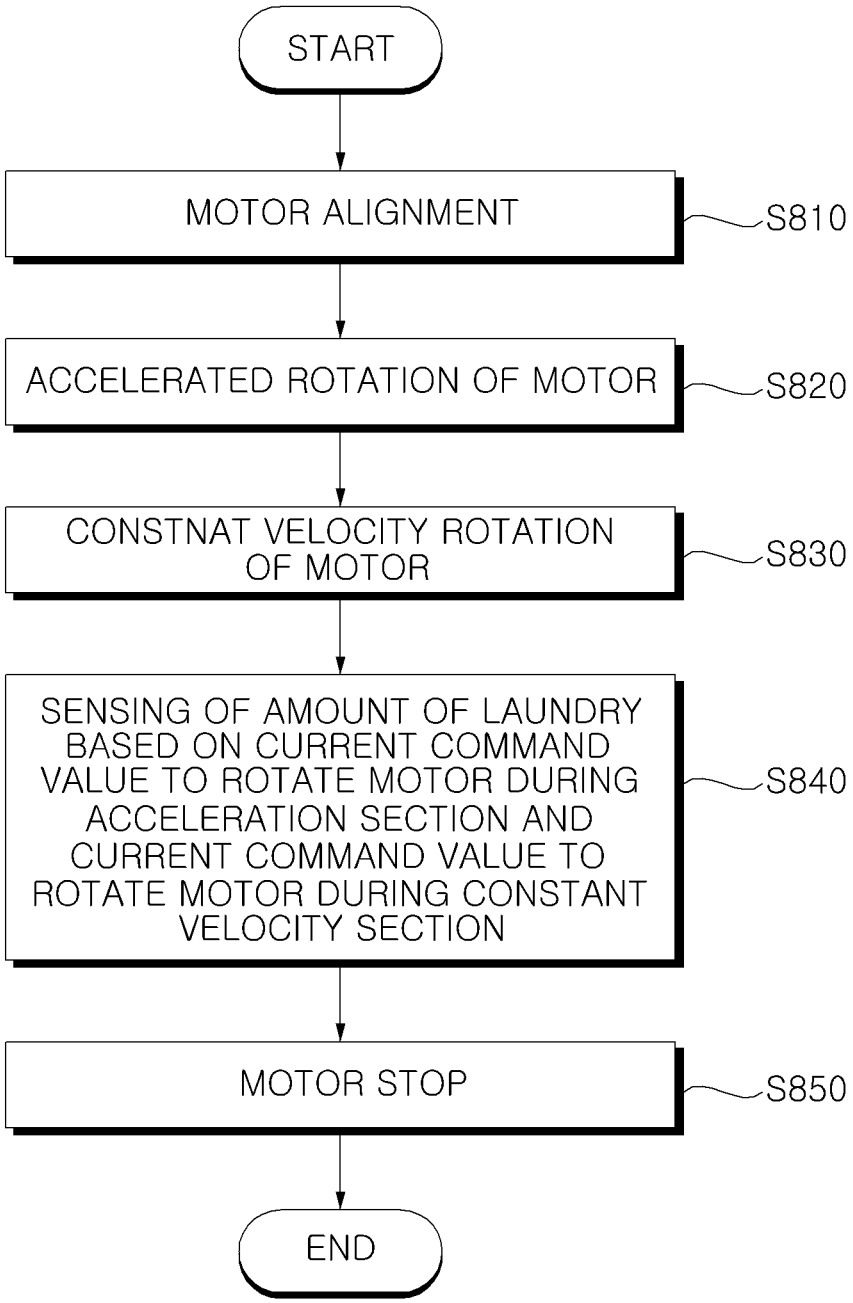

FIG. 8 illustrates one example of the method of sensing amount of laundry in the laundry treatment machine according to an embodiment of the present invention.

Referring to FIG. 8, to sense amount of laundry in the laundry treatment machine according to the embodiment of the present invention, first, the drive unit 220 aligns the motor 230 that is used to rotate the tub 120 (S810). That is, the motor 230 is controlled such that the rotor of the motor 230 is fixed at a given position. That is, constant current is applied to the motor 230.

To this end, any one switching element among the three upper arm switching elements of the inverter 420 is turned on, and the other two lower arm switching elements, which are not paired with the turned-on upper arm switching element, are turned on.

Figure 9:
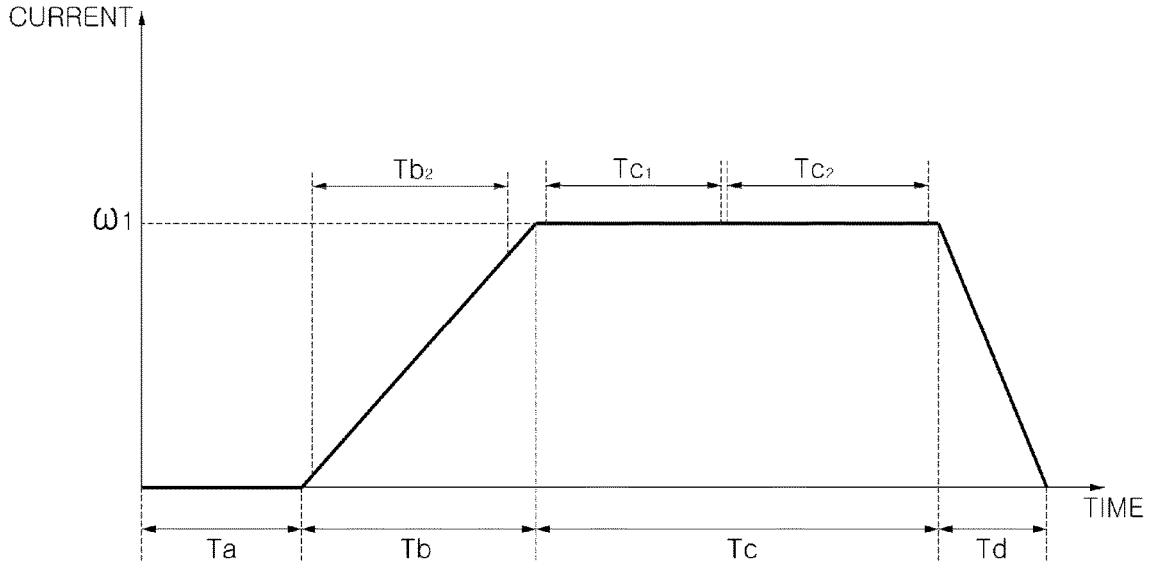

Such a motor alignment section may correspond to a section Ta of FIG. 9.

In one example, during the motor alignment section Ta, constant current may be applied to the motor 230. Thus, the rotor of the motor 230 is moved to a given position.

Alternatively, in another example, during the motor alignment section Ta, different values of current may be applied. This serves to calculate a motor constant that may be used for calculation of back electromotive force in a constant velocity rotating section Tc that will be described hereinafter. Here, the motor constant, for example, may mean an equivalent resistance value Rs of the motor 230.

Figure 10:
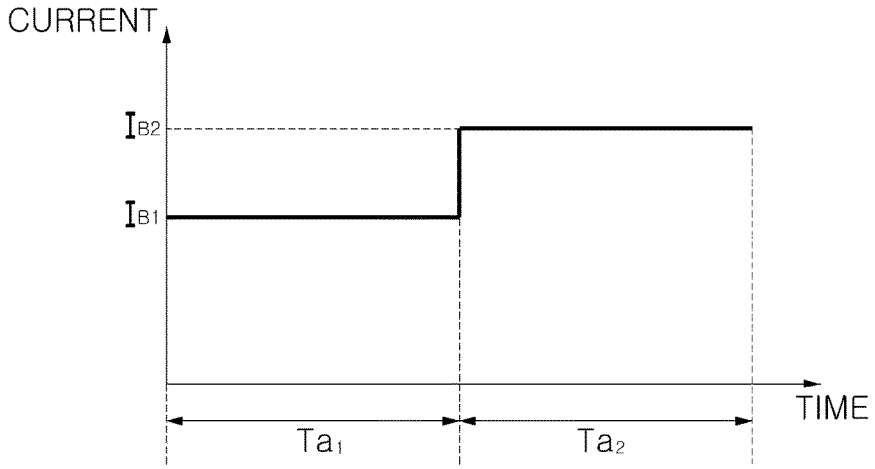

FIG. 10 illustrates that first current $I_{B1}$ flows through the motor 230 during a first section $Ta_1$ among the motor alignment section Ta, and second current $I_{B2}$ flows through the motor 230 during a second section $Ta_2$.

Here, the first section $Ta_1$ and the second section $Ta_2$ may have the same length, and the second current $I_{B2}$ may be two times the first current $I_{B1}$.

$$R_s = C1 \cdot \left( \sum_{n=1}^{k1} v_{q2}^* - \sum_{n=1}^{k1} v_{q1}^* \right) \Big/ \left( \sum_{n=1}^{k1} i_{q2}^* - \sum_{n=1}^{k1} i_{q1}^* \right) \quad \text{Equation 1}$$

Here, Rs is a motor constant that denotes an equivalent resistance value of the motor 230, C1 denotes a proportional constant, $v^*_{q1}$, $i^*_{q1}$ respectively denote a voltage command value and a current command value for the first section $Ta_1$, and $v^*_{q2}$, $i^*_{q2}$ respectively denote a voltage command value and a current command value for the second section $Ta_2$. In addition, k1 denotes a discrete value corresponding to a length of the first section $Ta_1$ and the second section $Ta_2$.

It is noted that, although both the voltage command value and the current command value may include d-axis component and q-axis component values, the following description assumes that both a d-axis voltage command value and a d-axis current command value are set to zero. Thus, in the following description, both the voltage command value and the current command value are related to a q-axis component.

In addition, in FIG. 10, calculation of a ΔV value in the motor alignment section Ta is possible.

$$\Delta V = C2 \cdot \left( 2 \times \sum_{n=1}^{k1} v_{q1}^* - \sum_{n=1}^{k1} v_{q2}^* \right) \Big/ k1 \quad \text{Equation 2}$$

Here, ΔV denotes a tolerance present between voltage command values. That is, assuming that the second current $I_{B2}$ is two times the first current $I_{B2}$, two times the voltage command value $v^*_{q1}$ during the first section $Ta_1$ must be equal to the voltage command value $v^*_{q1}$ during the second section $Ta_2$. Otherwise, there will present a tolerance ΔV between the voltage command values. ΔV may be utilized later for calculation of a back electromotive force compensation value.

In addition, C2 denotes a proportional constant, and k1 denotes a discrete value corresponding to a length of the first section $Ta_1$ and the second section $Ta_2$.

Next, the drive unit 220 accelerates a rotation velocity of the motor 230 that is used to rotate the tub 120 (S820). More specifically, the drive unit 220 may accelerate the rotation velocity of the motor 230 that remains stationary to reach a first velocity ω1. For this accelerated rotation, a current command value to be applied to the motor 230 may sequentially increase.

The first velocity ω1 is a velocity that may deviate from a resonance band of the tub 120, and may be a value within a range of approximately 40~50 RPM.

The motor accelerated rotating section may correspond to a section Tb of FIG. 9.

The inverter controller 430 in the drive unit 220 or the controller 210 may calculate an average current command value $i^*_{q_ATb}$ based on a current command value $i^*_{q_Tb}$ during a partial section $Tb_1$ among the accelerated rotating section Tb.

That is, the average current command value $i^*_{q_ATb}$ for the accelerated rotating section Tb may be calculated by the following Equation 3.

$$i^*_q_\mathrm{ATb} = \sum_{n=1}^{k2} (i^*_q_\mathrm{Tb})/k2 \qquad \text{Equation 3}$$

Here, k2 denotes a discrete value corresponding to a length of the partial section $Tb_1$ among the accelerated rotating section Tb.

Next, the drive unit 220 rotates the motor 230, which is used to rotate the tub 120, at a constant velocity (S830). More specifically, the drive unit 220 may cause the motor 230 that has accelerated to the first velocity ω1 to constantly rotate at a second velocity ω2. For this constant velocity rotation, a current command value to be applied to the motor 230 may be constant.

The second velocity ω2 is less than the first velocity ω1, and may be a value within a range of approximately 25~35 RPM.

The motor constant velocity rotating section may correspond to a section Tc of FIG. 9.

The inverter controller 430 in the drive unit 220 or the controller 210 may calculate an average current command value $i^*_{q_ATc}$ based on a current command value $i^*_{q_Tc}$ during a partial section $Tc_2$ among the constant velocity rotating section Tc.

That is, the average current command value $i^*_{q_ATc}$ for the constant velocity rotating section Tc may be calculated by the following Equation 4.

$$i^*_q_\mathrm{ATc} = \sum_{n=1}^{k3} (i^*_q_\mathrm{Tc})/k3 \qquad \text{Equation 4}$$

Here, k3 denotes a discrete value corresponding to a length of the partial section $Tc_2$ among the constant velocity rotating section Tc.

The constant velocity rotating section Tc, following the accelerated rotating section, may be divided into a stabilizing section $Tc_1$ to stabilize the tub 120, and a calculating section $Tc_2$ to add up motor current command values for sensing of amount of laundry.

The stabilizing section $Tc_1$ may be extended as the amount of laundry in the tub 120 increases. In particular, the inverter controller 430 in the drive unit 220 or the controller 210 may indirectly recognize whether amount of laundry is great or small based on a current command value for the accelerated rotating section, for example, the average current command value $i^*_{q_ATb}$. Then, the inverter controller 430 in the drive unit 220 or the controller 210 may determine a length of the stabilizing section based on the amount of laundry.

Herein, it is described that the first velocity ω1 of the accelerated rotating section Tb differs from the second velocity ω2 of the constant velocity rotating section Tc, the final velocity of the accelerated rotating section may be equal to the velocity of the constant velocity rotating section.

For example, the highest velocity of the accelerated rotating section Tb may be equal to the second velocity ω2 of the constant velocity rotating section Tc. In this case, the accelerated rotating section may be reduced because the highest velocity during accelerated rotation is equal to the second velocity ω2 that is less than the first velocity ω1. In conclusion, rapid sensing of amount of laundry may be implemented.

In addition, a length of the stabilizing section may be reduced because the highest velocity during accelerated rotation is equal to the second velocity ω2 that is less than the first velocity ω1.

The inverter controller 430 in the drive unit 220 or the controller 210 may calculate back electromotive force based on a current command value and a voltage command value required to drive the motor 230 during the constant velocity rotating section Tc. For the constant velocity rotating section, it is preferable to calculate back electromotive force generated by the motor 230 because the current command value and the like are variable during the accelerated rotating section.

Calculation of back electromotive force may be accomplished in various ways.

In one example, during the accelerated rotating section, a three-phase PWM method (180° electrical conduction with respect to each phase) in which the motor 230 is driven by all three-phases PWM signals may be adopted. Then, during the constant velocity rotating section, a two-phase PWM method in which the motor 230 is driven in two-phases only among three-phases may be adopted. Thereby, since current is not always applied in the remaining phase, detection of back electromotive force via the corresponding one phase is possible. For example, a voltage sensor to detect back electromotive force may be used.

In another example, direct calculation of back electromotive force may be adopted. The following Equation 5 illustrates calculation of back electromotive force emf.

$$emf = v_q^*_Tc - Rs\cdot(i_q^*_Tc) - Ls\cdot\omega_r^*\cdot i_d^* \qquad \text{Equation 5}$$

Here, $v^*_{q_Tc}$ denotes a voltage command value, $i^*_{q_Tc}$ denotes a current command value, Ls denotes an equivalent inductance component of the motor 230, $\omega^*_r$ denotes a velocity command value, and $i^*_d$ denotes a d-axis current command value.

As described above, assuming that the d-axis current command value $i^*_d$ is set to zero, Equation 5 may be arranged as the following Equation 6.

$$emf = v_q^*_Tc - Rs\cdot(i_q^*_Tc) \qquad \text{Equation 6}$$

That is, the back electromotive force emf may be determined based on the voltage command value and the current command value for the constant velocity rotating section and the motor constant, i.e. the equivalent resistance value Rs of the motor 230.

In addition, an average back electromotive force value emf_ATC may be calculated by the following Equation 7.

$$\text{emf_ATc} = \sum_{n=1}^{k3} (\text{emf})/k3 \qquad \text{Equation 7}$$

Here, k3 denotes a discrete value corresponding to a length of the section upon calculation of back electromotive force. As described above, k3 may be a discrete value corresponding to a length of the partial section $Tc_2$ among the constant velocity rotating section Tb. That is, the section for calculation of back electromotive force may be equal to the section for calculation of a current command value.

The inverter controller 430 in the drive unit 220 or the controller 210 may calculate and utilize a back electromotive force compensation value emf_com for the purpose of accurate measurement during sensing of amount of laundry. The back electromotive force compensation value emf_com may be calculated by the following Equation 8.

$$emf_com = C3 \cdot (emf_ATc + C4 \times \Delta V) \qquad \text{Equation 8}$$

Here, C3 and C4 respectively denote proportional constants. It will be appreciated that the back electromotive force compensation value emf_com is proportional to the average back electromotive force value emf_ATC and the voltage tolerance ΔV.

Next, the inverter controller 430 in the drive unit 220 or the controller 210 senses amount of laundry in the tub 120 based on output current flowing through the motor 230 that is used to rotate the tub 120 during the accelerated rotating section and output current flowing through the motor 230 during the constant velocity rotating section (S840).

Referring to the above description with respect to FIG. 5, a current command value required to rotate the motor 230 may be calculated based on the output current $i_o$ flowing through the motor 230.

Herein, implementation of sensing of amount of laundry based on the output current $i_o$ flowing through the motor 230 during the accelerated rotating section and during the constant velocity rotating section may mean that sensing of amount of laundry is implemented based on current command values required to rotate the motor 230 during the accelerated rotating section and during the constant velocity rotating section.

The following Equation 9 illustrates calculation of a sensed amount of laundry value Ldata according to the embodiment of the present invention.

$$L\text{data} = emf_com \cdot (i_q{}^*_ATb - i_q{}^*_ATc) \qquad \text{Equation 9}$$

The inverter controller 430 in the drive unit 220 or the controller 210 may implement sensing of amount of laundry based on a difference between the average current command value to rotate the motor 230 during the accelerated rotating section and the average current command value to rotate the motor 230 during the constant velocity rotating section. In this way, efficient sensing of amount of laundry may be accomplished.

The current command value to rotate the motor 230 during the accelerated rotating section may mean a current command value in which an inertia component and a friction component are combined with each other, and the current command value to rotate the motor 230 during the constant velocity rotating section may mean a current command value corresponding to a frictional component without an inertia component corresponding to acceleration.

In the embodiment of the present invention, to compensate for the frictional component as a physical component of the motor 230, sensing of amount of laundry is implemented based on a difference between the average current command value to rotate the motor 230 during the accelerated rotating section and the average current command value to rotate the motor 230 during the constant velocity rotating section. In this way, efficient sensing of amount of laundry may be accomplished.

That is, a sensed amount of laundry increases as a difference between the average current command value to rotate the motor 230 during the accelerated rotating section and the average current command value to rotate the motor 230 during the constant velocity rotating section increases.

The inverter controller 430 in the drive unit 220 or the controller 210 may implement sensing of amount of laundry based on the calculated back electromotive force during sensing of amount of laundry, more particularly, using the back electromotive force compensation value emf_com.

Referring to Equations 7 to 9, if the voltage command value $v^*_{q_Tc}$ increases and the current command value $i^*_{q_Tc}$ is reduced, the back electromotive force emf may increase and thus, the back electromotive force compensation value emf_com may increase. In conclusion, the sensed amount of laundry value Ldata may increase. In addition, it will be appreciated that reduction in the calculated equivalent resistance value Rs of the motor 230 results in increase in the sensed amount of laundry value Ldata.

After sensing of amount of laundry is completed, the drive unit 220 stops the motor 230 (S850). The motor stop section may correspond to a section Td of FIG. 9. Thereafter, the inverter controller 430 in the drive unit 220 or the controller 210 may control following operations depending on the sensed amount of laundry.

As described above, implementation of sensing of amount of laundry based on the output current $i_o$ flowing through the motor 230 during the accelerated rotating section and during the constant velocity rotating section may mean that sensing of amount of laundry is implemented based on current command values required to rotate the motor 230 during the accelerated rotating section and during the constant velocity rotating section.

The above-described sensing of amount of laundry may be applied to a washing process and a dehydration process among washing, rinsing, and dehydration processes of the laundry treatment machine.

Although FIG. 1 illustrates a top load type laundry treatment machine, the method of sensing amount of laundry according to the embodiment of the present invention may be applied to a front load type laundry treatment machine.

The laundry treatment machine according to the present invention is not limited to the above described configuration and method of the above embodiments, and all or some of the above embodiments may be selectively combined to achieve various modifications.

The method of operating the laundry treatment machine according to the present invention may be implemented as processor readable code that can be written on a processor readable recording medium included in the laundry treatment machine. The processor readable recording medium may be any type of recording device in which data is stored in a processor readable manner.

As is apparent from the above description, according to the embodiment of the present invention, in a laundry treatment machine, amount of laundry in a tub is primarily sensed. After water is supplied into the tub to a first water level, the level of water in the tub is sensed. Then, amount of the laundry in the tub is secondarily sensed. Thereby, whether the laundry includes dry laundry or wet laundry is judged using the primarily sensed amount of laundry, the secondarily sensed amount of laundry, and the sensed water level value. If it is judged that the laundry includes wet laundry, amount of the laundry is calculated based on the primarily sensed amount of laundry, the secondarily sensed amount of laundry, and the sensed water level value. If it is judged that the laundry includes dry laundry, amount of the laundry is calculated based on the primarily sensed amount of laundry. In this way, rapid and accurate sensing of amount of laundry may be accomplished.

In particular, in the case in which the laundry includes wet laundry, amount of laundry is sensed in consideration of moisture content, which ensures accurate sensing of amount of laundry. Accordingly, laundry treatment depending on an inherent fabric weight is possible, resulting in reduced washing time and water consumption. In conclusion, energy consumption by the laundry treatment machine may be reduced.

In the primary amount of laundry sensing and the secondary amount of laundry sensing, sensing of amount of laundry may be efficiently implemented as amount of the laundry in the tub is sensed based on a current command value to drive the motor during an acceleration section and a current command value to drive the motor during a constant velocity section.

More accurate sensing of amount of laundry may be accomplished by calculating back electromotive force generated from the motor during the constant velocity section and applying the calculated back electromotive force to sensing of amount of laundry.

The acceleration section is implemented after motor alignment, which ensures more accurate sensing of amount of laundry.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of operating a laundry treatment machine that processes laundry via rotation of a tub, the method comprising:

performing a primary sensing of an amount of laundry within the tub;

supplying water to a first water level within the tub;

sensing the level of water within the tub;

performing a secondary sensing of the amount of laundry within the tub;

judging whether the laundry includes dry laundry or wet laundry using the primarily sensed amount of laundry, the secondarily sensed amount of laundry, and the sensed water level value, wherein each of the primary amount of laundry sensing and the secondary amount of laundry sensing includes:

accelerating a rotational velocity of the tub during an accelerated rotating section;

rotating the tub at a constant velocity during a constant velocity rotating section; and calculating the amount of laundry in the tub based on a difference between an average current command value to rotate the motor during the accelerated rotating section and an average current command value to rotate the motor during a calculating section of the constant velocity rotating section, wherein the constant velocity rotating section is divided into a stabilizing section to stabilize the tub and the calculating section to add up current command values for sensing of amount of laundry, wherein a length of the stabilizing section is changed based on the average current command value during the accelerated rotating section, and wherein the average current command value during the constant velocity rotating section is calculated based on the current command values during the calculating section.

2. The method of claim 1, further comprising:

when the laundry is judged to include wet laundry, calculating the amount of laundry based on the primarily sensed amount of laundry, the secondarily sensed amount of laundry, and the sensed water level value; and when the laundry is judged to include dry laundry, calculating the amount of laundry based on the primarily sensed amount of laundry.

3. The method of claim 1, further comprising rotating, in an alternating forward/reverse direction, a motor that is used to rotate the tub, wherein said rotating occurs between the supply of water to the first water level and the sensing of the water level.

4. The method of claim 1, further comprising resupplying water to the first water level within the tub if the first water level is higher than the sensed water level, wherein said resupplying occurs after the water level sensing step.

5. The method of claim 1, wherein each of the primary amount of laundry sensing and the secondary amount of laundry sensing further comprises:

calculating a back electromotive force generated by the motor during the constant velocity rotating section, wherein the step of calculating the amount of laundry is based on an output current during the accelerated rotating section, an output current during the constant velocity rotating section, and the back electromotive force during the constant velocity rotating section.

6. The method of claim 1, wherein each of the accelerated rotating and the constant velocity rotating includes:

detecting current flowing through the motor;

calculating a velocity of a rotor of the motor based on the detected current;

generating a current command value based on the velocity of the rotor and a velocity command value;

generating a voltage command value based on the current command value and the detected current; and outputting a motor drive signal based on the voltage command value.

7. The method of claim 1, wherein the tub is accelerated to a first rotational velocity during the accelerated rotating section, and wherein the tub is maintained at a second rotational velocity that is less than the first rotational velocity during the constant velocity rotating section.

8. The method of claim 1, wherein the tub is accelerated to a second rotational velocity during the accelerated rotating section, and wherein the tub is constantly rotated at the second rotational velocity during the constant velocity rotating section.

9. The method of claim 1, wherein the judging whether the laundry includes dry laundry or wet laundry includes:

judging that the laundry includes dry laundry, if the primarily sensed amount of laundry is less than a reference value; and judging that the laundry includes wet laundry based on the secondarily sensed amount of laundry and the sensed water level value, if the primarily sensed amount of laundry is equal to or greater than the reference value.

10. The method of claim 5, further comprising:

aligning the motor, wherein the motor alignment includes applying a first current to the motor and applying a second current to the motor, wherein a tolerance between voltage command values is calculated based on the first current to the motor the second current during aligning the motor, wherein back electromotive force compensation is calculated based on a tolerance between voltage command values, and wherein the amount of laundry increases as the back electromotive force compensation increases.

11. The method of claim 1, further comprising:

aligning the motor, wherein the motor alignment includes applying a first current to the motor and applying a second current to the motor, wherein the amount of laundry increases as the difference between the average current command value to rotate the motor during the accelerated rotating section and the average current command value to rotate the motor during the constant velocity rotating section increases, wherein equivalent resistance value of the motor is calculated based on the first current to the motor the second current during aligning the motor, and wherein the amount of laundry increases as the calculated equivalent resistance value of the motor decreases.

* * * * *